US011390439B2

(12) United States Patent
Pruitt, II et al.

(10) Patent No.: US 11,390,439 B2
(45) Date of Patent: Jul. 19, 2022

(54) HARDWARE PACKAGING

(71) Applicant: LIBERTY HARDWARE MFG. CORP., Winston-Salem, NC (US)

(72) Inventors: James William Pruitt, II, Winston-Salem, NC (US); Ryan Patrick Martin, Kernersville, NC (US); James Leroy Daniels, Stokesdale, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 83 days.

(21) Appl. No.: 16/028,914

(22) Filed: Jul. 6, 2018

(65) Prior Publication Data

US 2019/0009962 A1 Jan. 10, 2019

Related U.S. Application Data

(60) Provisional application No. 62/529,906, filed on Jul. 7, 2017.

(51) Int. Cl.

| | |
|---|---|
| ***B65D 73/00*** | (2006.01) |
| ***B65B 15/00*** | (2006.01) |
| ***B65D 75/36*** | (2006.01) |

(52) U.S. Cl.

CPC ..... *B65D 73/0014* (2013.01); *B65B 15/00* (2013.01); *B65D 73/0064* (2013.01); *B65D 75/366* (2013.01); *B65D 75/367* (2013.01)

(58) Field of Classification Search

CPC ..... B65D 73/0014; B65D 73/0078; B65D 75/366; B65D 75/367; B65D 73/0064; B65D 73/02; B65D 65/12; B65B 15/00

USPC ..... 206/310, 265, 487, 480, 775, 777, 779, 206/576, 722, 723, 724, 321, 763, 421, 206/482, 477, 565, 488, 493, 495

See application file for complete search history.

(56) References Cited

U.S. PATENT DOCUMENTS

| | | | | |
|---|---|---|---|---|
| 2,230,719 A | | 2/1941 | Guild | |
| 3,221,874 A | * | 12/1965 | Pitner | B65D 85/58 206/318 |
| 4,067,169 A | | 1/1978 | Zampini, Jr. et al. | |
| 4,083,448 A | | 4/1978 | Zampini, Jr. et al. | |
| 4,291,801 A | * | 9/1981 | Basili | G11B 23/0233 206/387.13 |
| D283,488 S | | 4/1986 | Stevens | |
| 5,769,217 A | * | 6/1998 | Derraugh | G11B 33/0427 206/232 |
| 6,523,689 B2 | * | 2/2003 | Mickel | B65D 75/366 206/468 |

(Continued)

FOREIGN PATENT DOCUMENTS

EP 0586311 A1 3/1994

*Primary Examiner* — Steven A. Reynolds

(74) *Attorney, Agent, or Firm* — Brooks Kushman P.C.

(57) ABSTRACT

A hardware packaging assembly and method are provided. A hardware component has a front appearance surface and a back mounting surface. A package backing has a forward receiving surface to receive the back mounting surface of the hardware component. A retention feature protrudes from the package backing to engage the hardware component with an interference fit. The retention feature retains the hardware component on the package backing while maintaining the front appearance surface exposed.

23 Claims, 7 Drawing Sheets

(56) References Cited

U.S. PATENT DOCUMENTS

| | | | | |
|---|---|---|---|---|
| 7,066,327 | B2 * | 6/2006 | Baublitz | B65D 75/22 206/303 |
| 7,122,740 | B2 * | 10/2006 | Xu | H02G 3/14 174/66 |
| 9,022,336 | B2 * | 5/2015 | Huynh | H02G 3/14 174/66 |
| 9,711,957 | B2 * | 7/2017 | Trojanowski | H02G 3/081 |
| 2005/0257951 | A1 * | 11/2005 | Xu | H02G 3/14 174/66 |

* cited by examiner

HARDWARE PACKAGING

CROSS-REFERENCE TO RELATED APPLICATIONS

This application claims the benefit of U.S. provisional application Ser. No. 62/529,906 filed Jul. 7, 2017, the disclosure of which is hereby incorporated in its entirety by reference herein.

TECHNICAL FIELD

The application relates to packaging materials for hardware components.

BACKGROUND

Hardware such as wall plates for switches, receptacles, and other in-wall electrical installations, are typically packaged for shipping and display at a retail store. The packaging also holds fasteners, such as screws which are supplied with the wall plate. The packaging may also include instructions and marketing material about the hardware. Typically, packaged hardware may be held in the package between two packaging components such as in a blister pack with a plastic cover secured to with a back card. Other packaging for hardware retains the hardware in the package with an attachment screw or the like.

SUMMARY

According to at least one embodiment, a packaging assembly for hardware is provided with a connection portion that holds the hardware component in from a back side of the component so that the front appearance surface of the component is exposed. The connection portion provides a snap-fit feature to retain the hardware component in the packaging assembly. The hardware component may appear to float in order to view a surface finish on the appearance surface without a cover. The packaging assembly does not have any protrusions out of the back of the packaging assembly.

In another embodiment, the connection portion may be a protrusion formed to a shape to mate with an opening in the hardware component, where the opening is adapted to receive an electrical component on a consumer's wall.

In another embodiment, the connection portion may be at least one detent formed along side walls of a cavity. The detent engages a periphery of the hardware component to retain the hardware component in the cavity.

In another embodiment, the packaging assembly does not cover at least one edge of the hardware component, thereby giving more of a floating look and allowing the consumer to take the product home and hold it up to their wall while still in the package to get a good feel for how it will look or allowing comparison with paint swatches at the store level, for example.

According to at least one embodiment, packaging for a hardware component is provided. The packing has a backing with a forward receiving surface adapted to receive a backside of the hardware component. A retention feature is integrally formed with the backing and protrudes from the backing. The retention feature is formed to engage the hardware component with an interference fit so that a front appearance surface of the hardware component is exposed.

In another embodiment, the retention feature protrudes forward from the forward receiving surface.

In another embodiment, the retention feature has a protrusion having a hardware shape and is adapted to engage a hardware aperture in the hardware component.

In another embodiment, the hardware shape has at least one of a switch and an electrical receptacle.

In another embodiment, the retention feature includes at least one detent that is adapted to elastically deform and engage the aperture with a snap-fit.

In another embodiment, the backing has a cavity defined by a plurality of side walls extending from the forward receiving surface.

In another embodiment, the retention feature protrudes from at least one of the plurality of side walls.

According to at least one other embodiment, a hardware packaging assembly is provided. A hardware component has a front appearance surface and a back mounting surface. A package backing has a forward receiving surface to receive the back mounting surface of the hardware component. A retention feature protrudes from the package backing to engage the hardware component with an interference fit to retain the hardware component on the package backing while maintaining the front appearance surface exposed.

In another embodiment, the hardware component has an aperture extending from the back mounting surface through to the front appearance surface. The retention feature protrudes generally perpendicular from the front receiving surface of the package backing and extends through the aperture in the hardware component.

In another embodiment, the hardware packaging assembly has at least one hardware fastener. A fastener cavity for receiving the hardware fastener is defined in the backing. The hardware fastener does not retain the hardware component to the backing.

In another embodiment, the backing has a recessed cavity defined by a plurality of side walls extending from the forward receiving surface, wherein the recessed cavity has a depth greater than a depth dimension of the hardware component.

In another embodiment, the retention feature comprises a detent that protrudes from at least one of the plurality of side walls and extends generally parallel to the forward receiving surface of the backing, wherein the detent engages a periphery of the hardware component.

In another embodiment, the hardware packaging assembly has a display feature extending from the backing.

In another embodiment, the hardware component has a plurality of side edges the define a periphery of the hardware component, and wherein the backing does not cover at least one of the side edges. In another embodiment, the hardware component comprises a wall plate.

According to at least one other embodiment, a method of forming a hardware packaging assembly is provided. The method includes molding a package backing. A retention feature is integrally molded with and protruding from the package backing. A hardware component is attached to the package backing. The hardware component is retained on the package backing with an interference fit by the retention feature.

In another embodiment, the package backing is molded of at least one of pulp and plastic.

In another embodiment, the hardware component is retained on the package backing so a front appearance surface of the component is exposed and not covered by the package backing.

In another embodiment, the retention feature protrudes generally perpendicular from a front receiving surface of the package backing and the hardware component comprises has an aperture. The hardware component is attached by inserting the retention feature through the aperture in the hardware component.

In another embodiment, the package backing has a recessed cavity and the retention feature protrudes from a periphery of the recessed cavity. The hardware component is attached by inserting the hardware component into the recessed cavity so the retention feature engages a hardware periphery.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
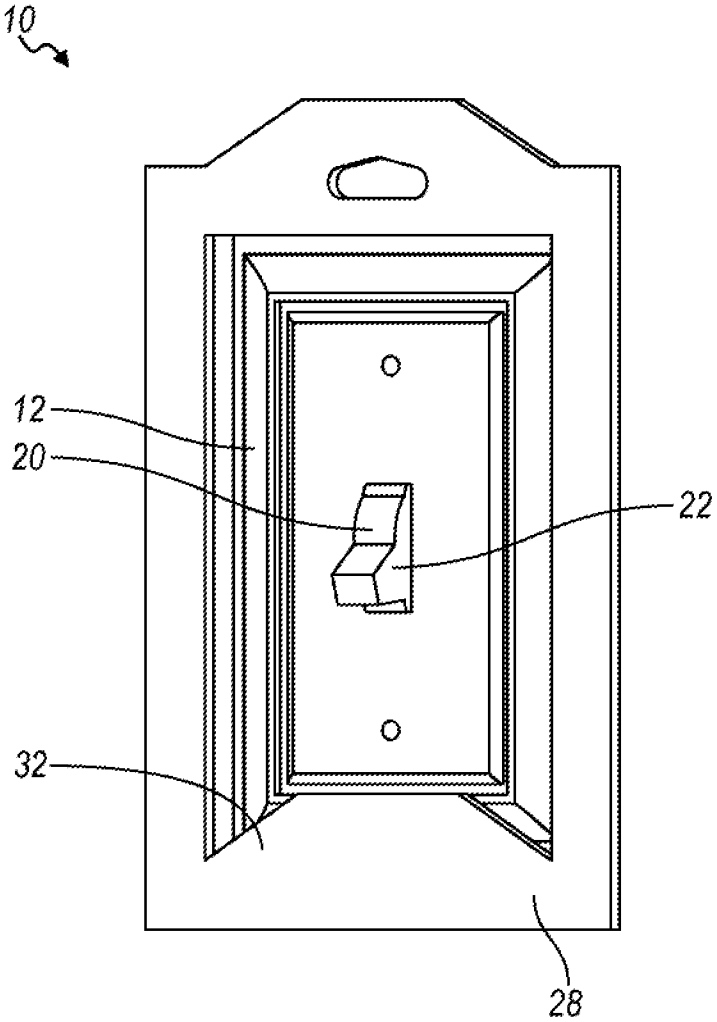
FIG. 1 illustrates a front view of a hardware packaging assembly according to one embodiment.

Surface finish and color tones of hardware may be important considerations when customers are purchasing hardware components, such as wall plates, for example, illustrated in FIG. 1. But typical packaging may prevent the customer from viewing the surface finish or color since the entire hardware component is covered. Even clear and transparent packaging may inhibit the customer from seeing true surface finish or color.

Typical hardware packaging has blister card having a clear plastic cover secured to a back card, where the plastic blister covers the appearance surface of the hardware. Some hardware packaging has a cutout in the plastic blister cover, but still does not allow the consumer to fully view the surface finish and color of the hardware component in the packaging.

The hardware packaging of the present application creates a retail package for hardware components, such as wall plates or other electrical enclosures, to be viewed by the consumer without a covering the entire hardware component with packaging. The packaging makes the entire appearance surface of the hardware component, including the edges, accessible without being covered, for interaction and to understand the exact color tones of the finish. Even though the appearance surface of the hardware component is accessible, the packaging still protects the hardware component from damage including scuffing or scratching.

FIG. 1 is a front perspective view of the packaging 10 for a hardware component 12. The hardware component 12 shown is a single wall plate, however, the packaging according to the present application may be used for other hardware types and configurations including a plurality of sizes such as single, double, triple, and quad wall plates or other suitable hardware designs.

Figure 2:
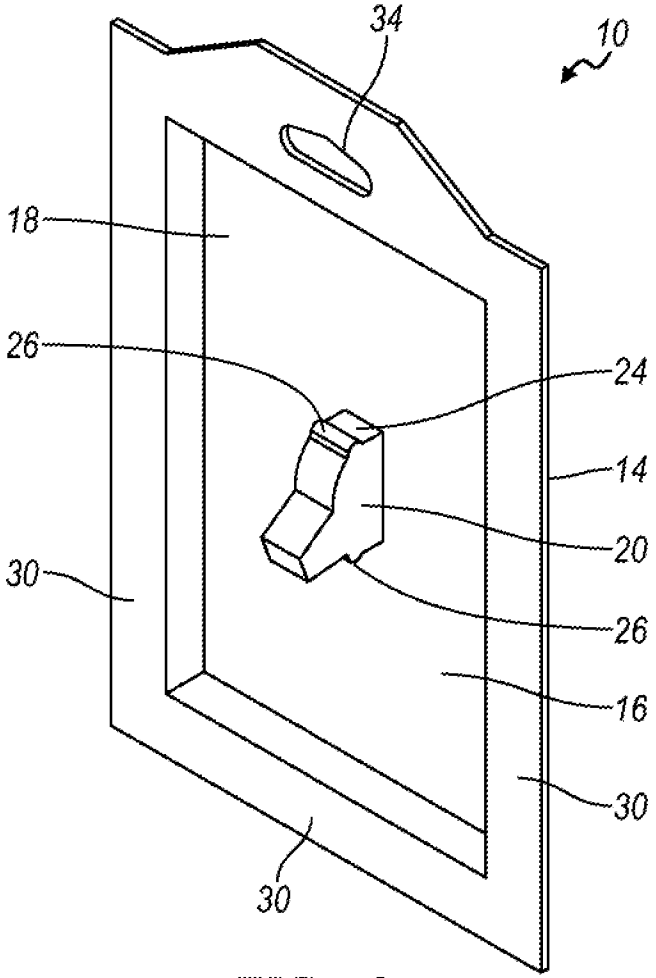
FIG. 2 illustrates a front perspective of a hardware package backing in FIG. 1.

As shown in FIG. 2, the packaging 10 may include a backing 14 with a recessed cavity 16. The backing has a forward receiving surface 18 that receives a backside, or the back mounting surface of the hardware component 12 that is typically mounted along the wall and concealed when in use. The backing 14 of the packaging includes a connection portion 20 for securing the hardware component 12 to the packaging 10. The connection portion 20 includes a protrusion 24 that protrudes from the forward receiving surface 18. The connection portion 20 is adapted to protrude through an aperture 22 in the hardware, as shown in FIG. 1. The aperture 22 may be a switch opening, as illustrated in FIG. 2, but the aperture 22 may also be an opening shaped for electrical outlets/receptacles the screw holes or other openings formed on the hardware component 12.

Figure 4:
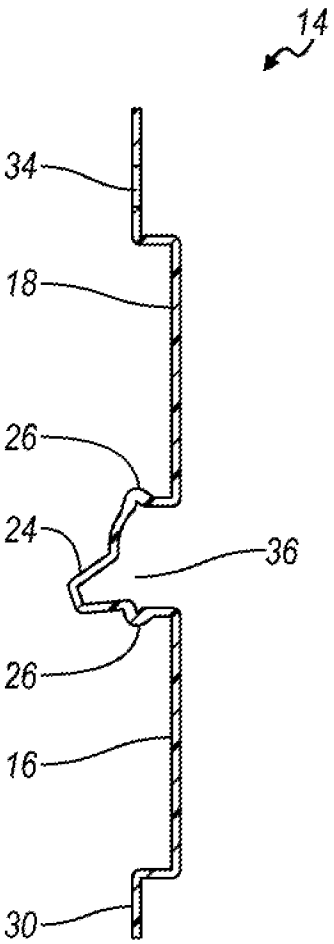
FIG. 4 illustrates a section view of the hardware package backing along the section 4-4 in FIG. 3.

As shown in the section view in FIG. 4, the connection portion 20 may include at least one detent 26 that provides an interference fit, or snap fit to secure the backing 14 to the hardware component 12. The detent 26 folds or elastically deforms as the hardware opening 22 receives the connection portion 20 thereby securing the hardware component to the backing 14 of the packaging. The connection portion 20 does not require clips or screws to secure the hardware to the backing 14 of the packaging 10. The protrusion 24 of the connection portion 20 can be a generic shape or be designed in a way to look like the product that will extend through the hardware component from the backside through to the front appearance surface once installed. For example, the protrusion 24 may be a hardware shape, such as a duplex, decorator, or switch, as shown in FIGS. 1-4. The protrusion 24 may also engage the backside of the hardware component. For example, the protrusion 24 may engage a ridge or groove formed on the backside of the hardware component or engage the periphery of the hardware component.

As shown in FIG. 1, a card 28 may be adhered or sealed to the backing 14. The card 28 may be cardstock, corrugated, adhesive label or plastic to provide graphics or additional structure, if so desired. However, the card 28 is not required and may not provide any retention of the hardware component 12 in the package 10. The front card 28 of the packaging may connect to the flanges 30 of the backing 14 or may adhered to other surfaces of the backing 14 that are not flat, depending on the material of the card 28. The card 28 may have a decorative shaped area 32 which may provide more of any artistic feel and that conceals a portion of the hardware component 12 while still leaving most the hardware component's appearance surface open for viewing or interaction by the consumer. The card 28 be placed on the front of the backing 14, as shown in FIG. 1. The card 28 may also be attached to the back or both the front and back of the backing 14 to give a "trapped look." The card 28 can also have folds or additional geometry to add depth to give the impression the hardware component is "floating" inside of a box.

Figure 3:
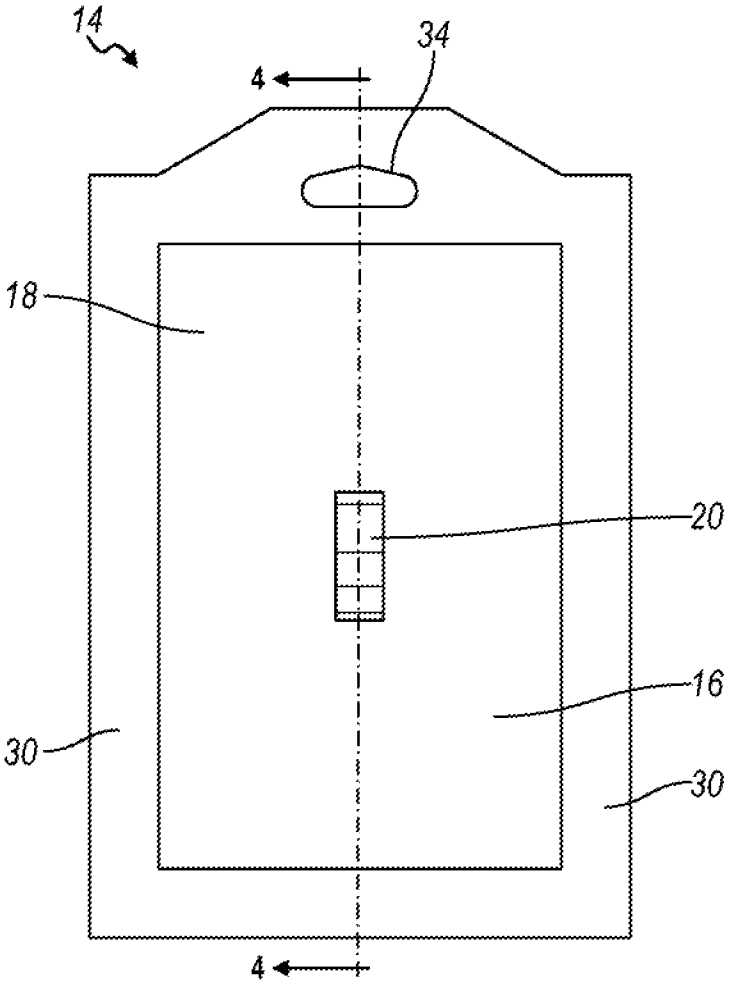
FIG. 3 illustrates a front view of the hardware package backing in FIG. 2.

Additionally, the backing 14 may include a display feature 34 for displaying the packaging 10 including the hardware component 12. For example, as shown in FIGS. 1-3, the backing 14 includes display feature 34 being a tab having a peg hole for hanging the packaging 10.

The packaging may also retain hardware fasteners, such as screws. Fasteners may be placed inside a cavity 36 formed opposite the protrusion 24. The cavity 36 in the backing 14 may be covered with a label, tape or a card to maintain the fasteners in the cavity 36. The backing 14 may be formed of various suitable materials including thermoformed plastics, paperboard, corrugated, or molded pulp, or other materials having elastic pliability to allow for snap fit engagement with the hardware component.

Figure 6:
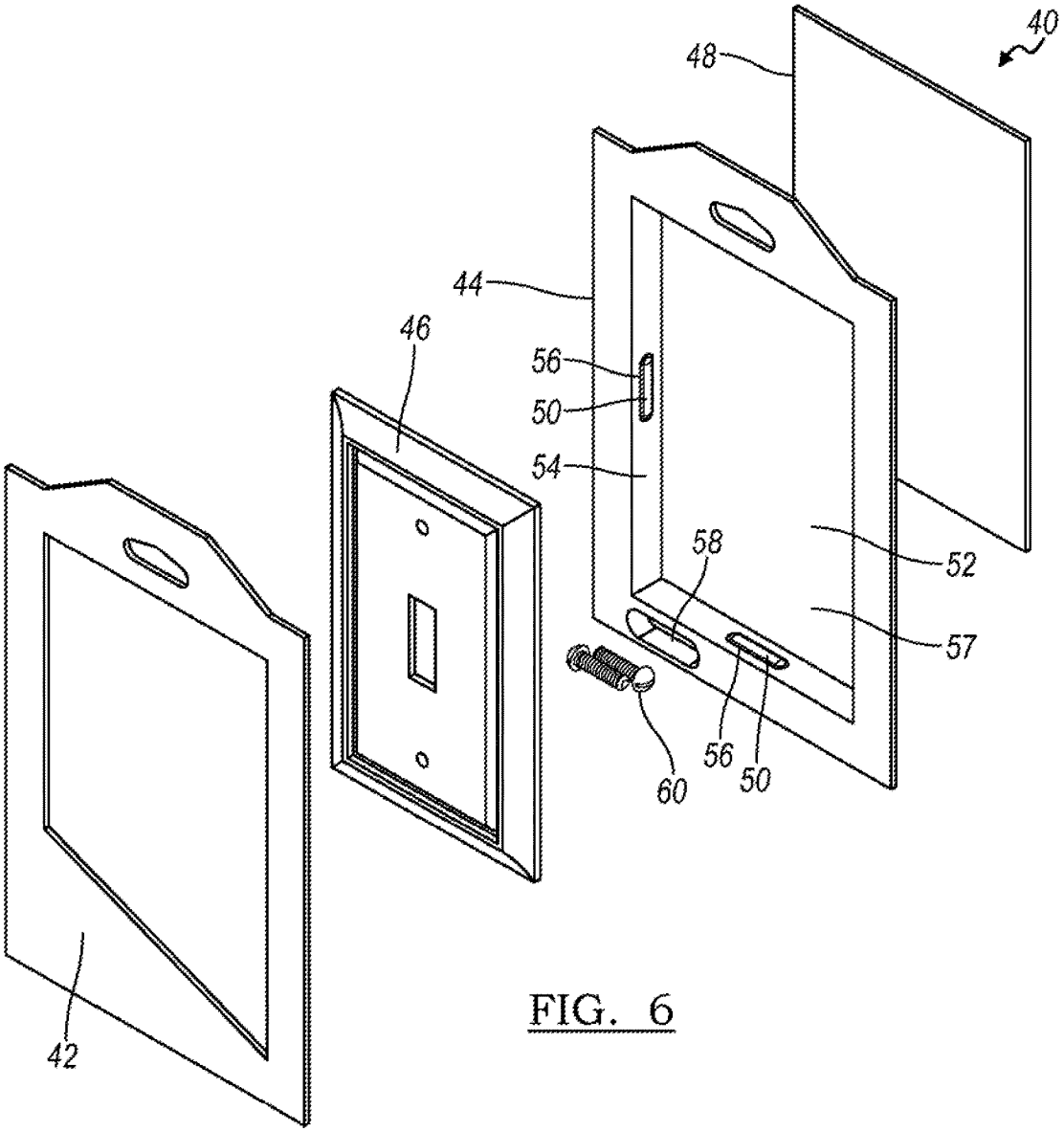
FIG. 6 illustrates an exploded view of the hardware packaging assembly in FIG. 5.

FIGS. 5-8 illustrate hardware packaging 40 according to another embodiment. FIG. 6 illustrates an exploded view of the packaging 40 that has a cover card 42 coupled to a backing 44. The hardware component 46 is secured in the backing 44. The packaging 40 may also include a label 48.

Figure 7:
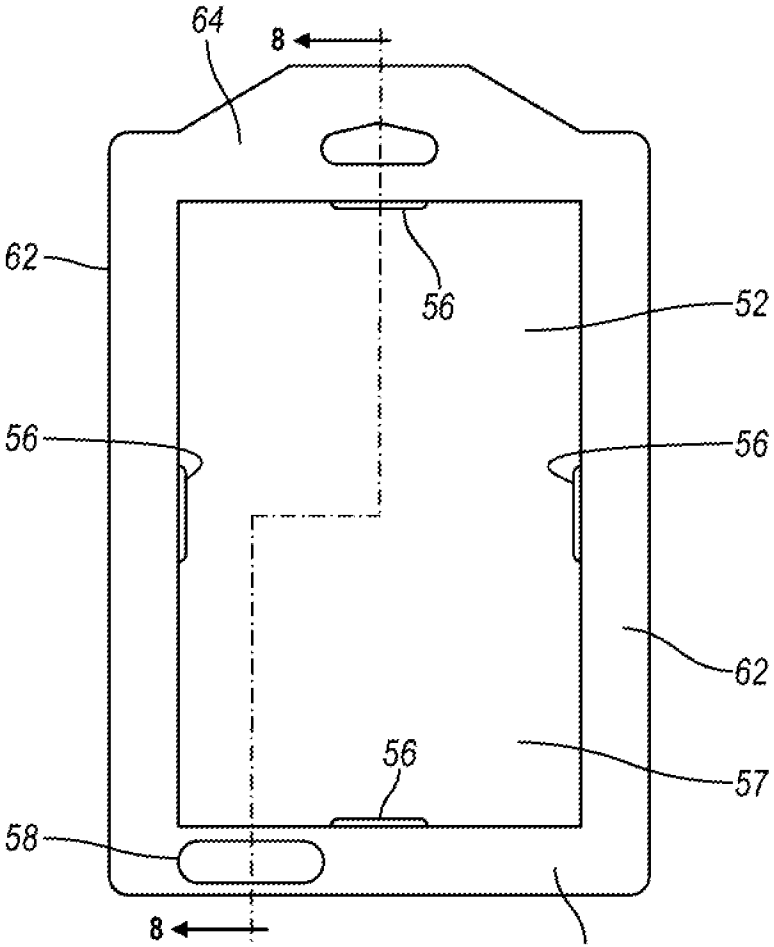
FIG. 7 illustrates a front view of the hardware package backing in FIG. 6.

The backing 44 of the packaging includes connection portions 50 for securing the hardware component 46 within the cavity 52 of the backing 44 with an interference fit. As shown in FIG. 7, the connection portions 50 include detents 56 along the side walls 54 that extend from the forward receiving surface 57 and form a periphery of the cavity 52. The side walls 54 extend from the forward receiving surface 57 to define the recessed cavity 52. The recessed cavity may have a depth greater than a depth dimension of the hardware component to help protect the exposed appearance surface during shipping and storage.

The detents 56 along the side walls 54 provide an interference fit, or snap fit to secure the backing 44 to the hardware component 46. The detents 56 flex or fold inwards allowing the hardware component 46 to slide over them. Once passed, the detents 56 return to their original shape to create a ridge over an edge of the hardware component 46 thereby locking the hardware component 46 in the backing 44. Any number of detents 56 may be provided. For example, one detent 56 along one side wall may provide enough retention. The detents 56 may be one millimeter and extend from the side walls 54 in a direction generally parallel to the forward receiving surface 57.

To remove the hardware component 46, the backing 44 is flexed to expose a corner of the hardware component 46 and pull to free it from the detents 56. The backing 44 does not require clips or screws or the cover card to secure the hardware to the backing 44.

Figure 5:
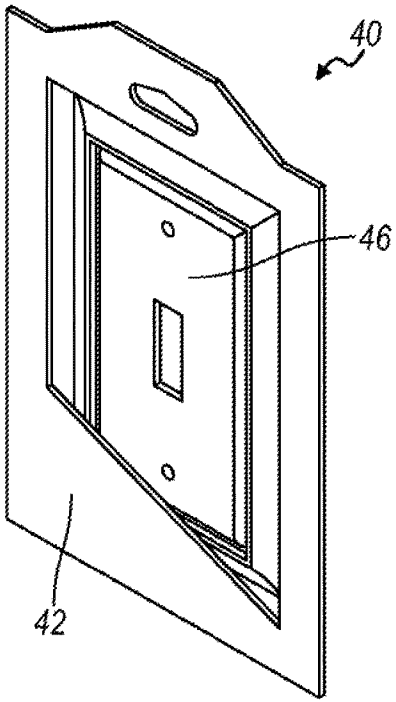
FIG. 5 illustrates a front perspective view of a hardware packaging assembly according to another embodiment.

As shown in FIGS. 5-6, a cover card 42 may be adhered or sealed to the backing 44. The cover card 42 may be cardstock, corrugated, adhesive label or plastic to provide graphics or additional structure, if so desired. However, the cover card 42 is not required and does not retain the hardware component 46 in the backing 44. The cover card 42 of the packaging may connect to the flanges 62 of the backing 44. The cover card 42 may have a decorative shaped area that conceals a portion of the hardware component 46 while still leaving most the hardware component's appearance surface open for viewing or interaction by the consumer.

Figure 8:
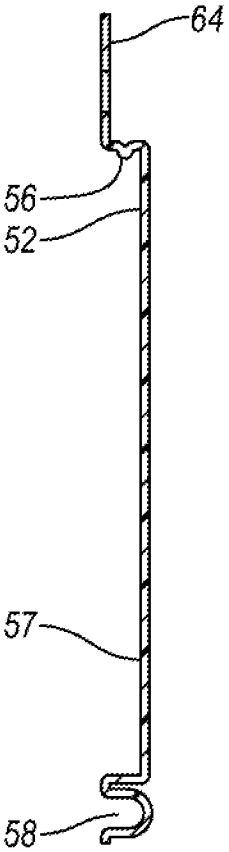
FIG. 8 illustrates a side section view of the hardware package backing along the section 8-8 in FIG. 7.

As shown in FIG. 6-8, a small cavity 58 for the hardware fasteners 60, such as screws, may be added into the backing 44. The fastener cavity 58 may extend inward from the front and may be covered by the cover card 42 to retain the fasteners in the cavity 58. Alternatively, the cavity 58 may be extend from a back surface in a direction opposite the cavity 52 and may be covered by the label 48, for example.

Additionally, the backing 44 may include a display feature 64 such as a tab with a peg opening or hook opening for hanging the packaging 40 including the hardware component 46. The display feature may also allow the packaging to stand or be displayed on shelves. For example, the display feature may include feet or a base along a lower edge to allow the packaging to stand. It is also contemplated that slits may be formed into the sidewalls of the cavity 52 to slide in and out paint samples, if required.

FIG. 9-12 illustrate a hardware packaging assembly according to other embodiments to the application where the packaging does not extend significantly beyond the sides of the hardware component. These embodiments allow a consumer to see how the hardware component 72 would look on a wall before taking it out of the package backing. Additionally, paint samples or wall coverings may be easily compared up against the hardware component while still in the store.

FIGS. 9-12 illustrate one embodiment of a hardware packaging assembly 70 where the backing 74 of the packaging includes a recessed cavity 76 formed by side walls 78 without any flanges and minimized thickness. The connection portions include detents 80 that extend from the side walls 78 and are generally parallel to the forward receiving surface 82 of the backing. The detents 80 retain the hardware component to the backing with a snap fit. Four detents 80 are illustrated, however, any number of detents may be provided, even a single detent 80 along one side wall 78 may be used to retain the hardware component. The side walls 78 have minimal thickness to minimize the width and height of the packaging 70.

Figure 10:
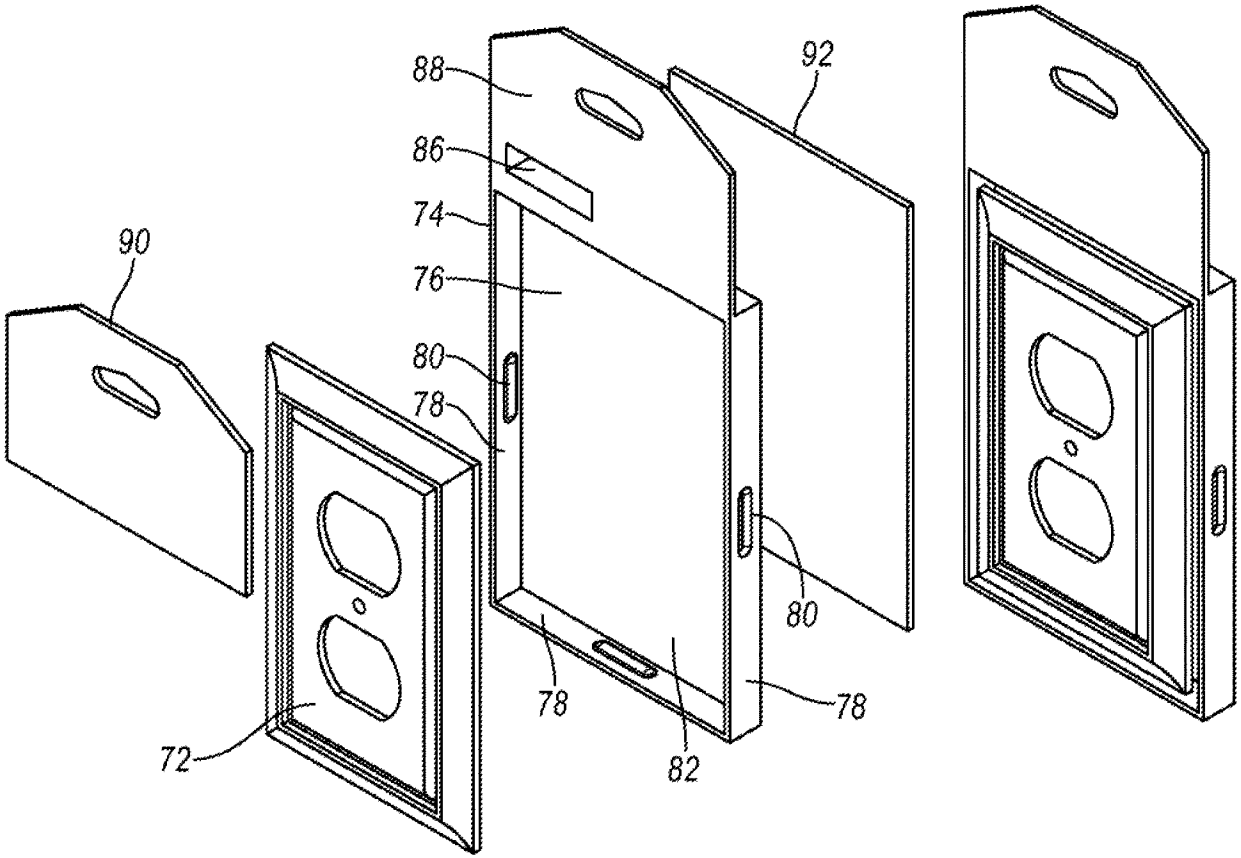
FIG. 10 illustrates an exploded view of a hardware packaging assembly according to another embodiment.
Figure 9:
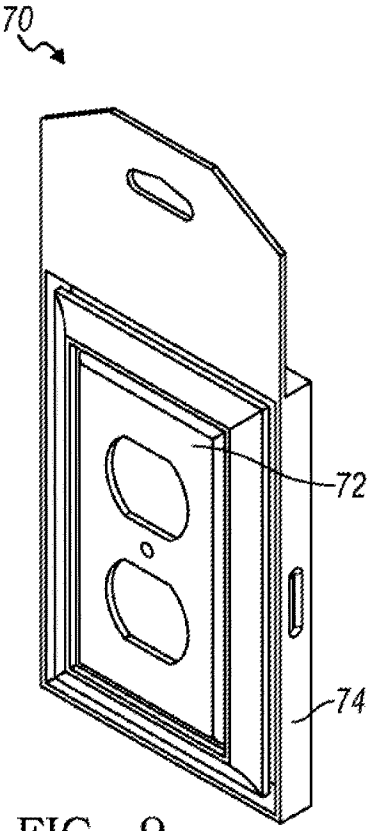
FIG. 9 illustrates a perspective view of a hardware packaging assembly according to another embodiment.
Figure 12:
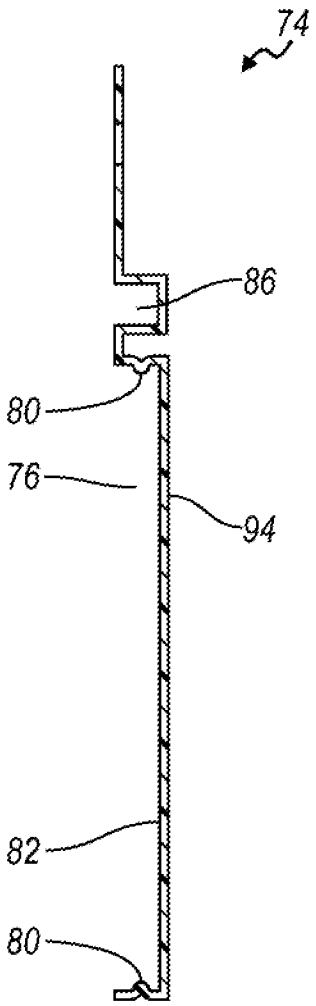
FIG. 12 illustrates a side section view of the hardware package backing along the section 12-12 in FIG. 11.
Figure 11:
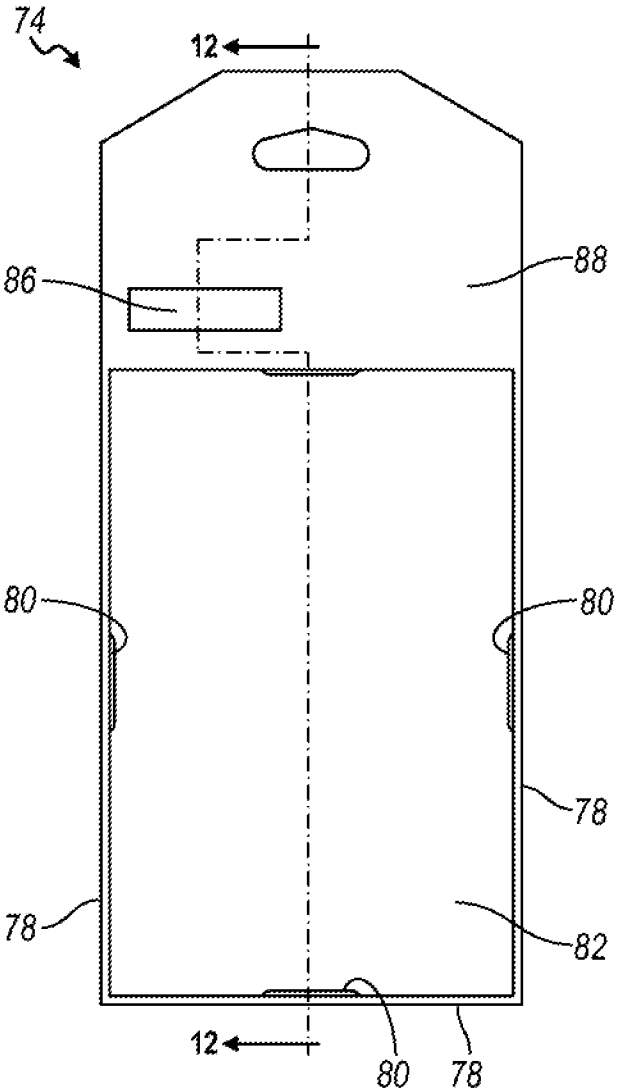
FIG. 11 illustrates a front view of the hardware package backing in FIG. 10.

The packaging assembly 70 does not require clips or screws or the cover card to secure the hardware component to the backing 74. A small cavity 86 may extend into the backing 74 from the front along the display tab 88 and may be covered by the cover card 90 to retain the fasteners in the cavity 86, as shown in FIG. 10. The packaging assembly 70 may also include a label 92 applied to a rear surface 94 of the backing 74. Alternatively, the cavity 86 may be extend from the rear surface 94 in a direction opposite the cavity 76, for example.

Figure 14:
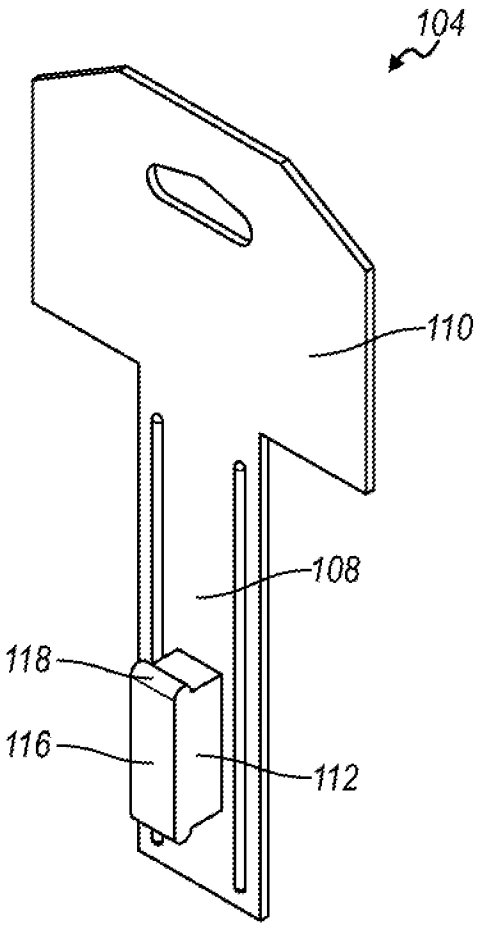
FIG. 14 illustrates a front perspective of a hardware package backing in FIG. 13.
Figure 13:
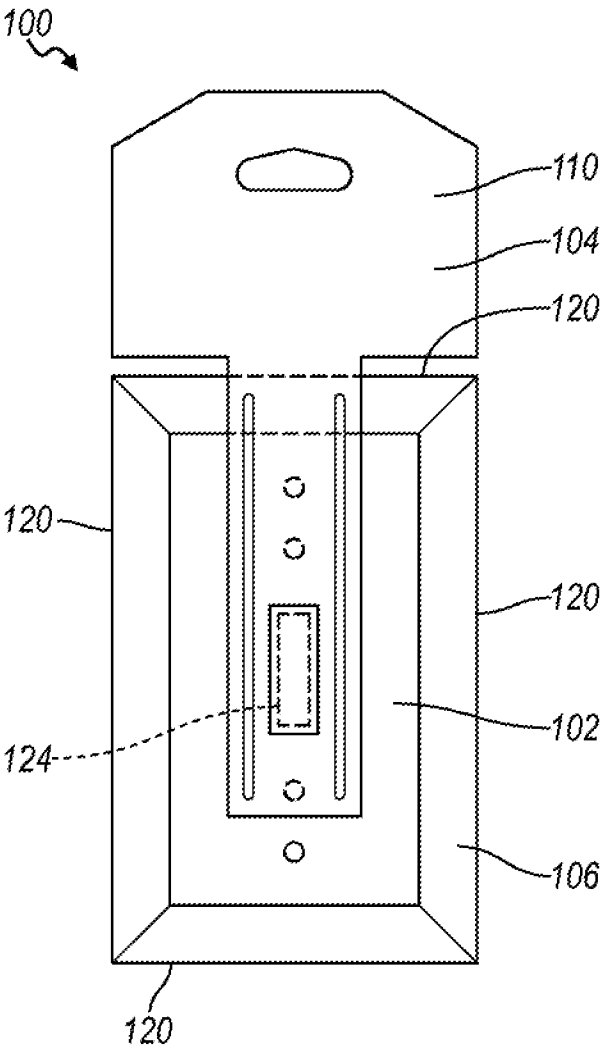
FIG. 13 illustrates a rear perspective view of a hardware packaging assembly according to another embodiment.

FIGS. 13-14 illustrate another embodiment of a hardware packaging assembly 100 where the packaging is minimized. The minimized packaging reduces packaging material costs, and allows the packaged hardware components 102 to be efficiently packed and stored during transportation and display. As shown in FIG. 13, the backing 104 does not cover at least a portion of the back mounting surface 106 of the hardware component 102, and does not cover all of the side edges 120 that define the periphery of the hardware component 102. Only the display feature 110 extends beyond the hardware component 102.

As shown in FIGS. 13-14, the backing 104 includes a display feature 110 having a tab and a peg hole for hanging the packaging assembly 100. The display tab 110 is connected to a backing strip 108 with a connection portion 112 for securing the hardware component 102 to the package backing 104. The connection portion 112 includes a protrusion 116 adapted to protrude through an opening in the hardware component 102. Similar to FIG. 4, the connection portion 112 includes at least one detent 118 that provides an interference fit, or snap fit to secure the backing 104 to the hardware component 102. The backing strip 108 does not extend to the lateral edges 120 of the hardware component 102 has a width minimized to be only somewhat wider than the hardware opening 124 so that the backing 104 does not cover a portion of the back mounting surface 106 of the hardware component 102.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hardware packaging assembly comprising:

an electrical wall plate having a front appearance surface and a backside, wherein the electrical wall plate has an aperture extending from the backside through to the front appearance surface; and a backing having a forward receiving surface adapted to receive the backside of the electrical wall plate; and a retention feature integrally formed with and protruding from the backing, the retention feature engaging the electrical wall plate with an interference fit so that the front appearance surface of the electrical wall plate is exposed, wherein the retention feature has a protrusion formed as a hardware shape that engages the aperture in the electrical wall plate and extends beyond the front appearance surface to simulate an installed configuration, wherein the protrusion has at least one detent to elastically deform and engage the electrical wall plate with a snap-fit to secure and retain the electrical wall plate to the backing, wherein the backing does not cover the front appearance surface of the electrical wall plate.

2. The hardware packaging assembly of claim 1, further comprising: at least one hardware fastener; and a fastener cavity for receiving the hardware fastener is defined along the backing, wherein the hardware fastener does not retain the electrical wall plate to the backing.

3. The hardware packaging assembly of in claim 1, further comprising a display feature extending from the backing for retail display of the packaging.

4. The hardware packaging assembly of claim 3, wherein the hardware shape comprises at least one of a switch and an electrical receptacle.

5. The hardware packaging assembly of claim 1, wherein the backing has a cavity defined by a plurality of side walls extending from the forward receiving surface.

6. The hardware packaging assembly of claim 5, wherein the retention feature protrudes from at least one of the plurality of side walls.

7. The hardware packaging assembly of claim 5, wherein the retention feature comprises a detent that protrudes from at least one of the plurality of side walls and extends generally parallel to the forward receiving surface of the backing, wherein the detent engages a periphery of the electrical wall plate.

8. The hardware packaging assembly of claim 1, wherein the electrical wall plate has a plurality of side edges that define a periphery of the electrical wall plate, and wherein the backing does not cover at least one of the side edges.

9. A hardware packaging assembly comprising:

an electrical wall plate having a front appearance surface and a back mounting surface, wherein the electrical wall plate has an aperture extending from the back mounting surface through to the front appearance surface; and a package backing having a front receiving surface to receive the back mounting surface of the electrical wall plate;

a retention feature protruding from the package backing to engage the electrical wall plate with an interference fit to retain the electrical wall plate on the package backing while maintaining the front appearance surface exposed, wherein the retention feature protrudes from the front receiving surface of the package backing and extends through the aperture in the electrical wall plate and protrudes forward from the front appearance surface;

at least one hardware fastener for mounting the electrical wall plate; and a fastener cavity for receiving the hardware fastener defined along the backing, wherein the hardware fastener does not retain the electrical wall plate to the backing.

10. The hardware packaging assembly of claim 9, further comprising a display feature extending from the backing.

11. The hardware packaging assembly of claim 9, wherein the electrical wall plate has a plurality of side edges that define a periphery of the electrical wall plate, and wherein the backing does not cover at least one of the side edges.

12. The hardware packaging assembly of claim 9, wherein the retention feature is a protrusion shaped as at least one of a switch and an electrical receptacle and protrudes through aperture in the electrical wall plate and extends beyond the front appearance surface to simulate an installed configuration.

13. The hardware packaging assembly of claim 9, wherein the package backing is molded of at least one of pulp and plastic.

14. The hardware packaging assembly of claim 9, wherein the front appearance surface of the electrical wall plate is exposed and not covered by the package backing.

15. The hardware packaging assembly of claim 9, wherein the retention feature protrudes generally perpendicular from a front receiving surface of the package backing.

16. The hardware packaging assembly of claim 9, wherein the package backing has a recessed cavity and the retention feature protrudes from a periphery of the recessed cavity, wherein the retention feature engages a periphery of the electrical wall plate.

17. The hardware packaging assembly of claim 9, wherein the retention feature includes at least one detent that adapted to elastically deform and engage the aperture with a snap-fit.

18. The hardware packaging assembly of claim 17, wherein the retention feature protrudes generally perpendicular from the front receiving surface of the package backing and the detent extends transverse to the retention feature.

19. A hardware packaging assembly comprising:

an electrical wall plate having a front appearance surface and a back mounting surface; and a package backing having a forward receiving surface to receive the back mounting surface of the electrical wall plate;

a retention feature protruding from the package backing to engage the electrical wall plate with an interference fit to retain the electrical wall plate on the package backing while maintaining the front appearance surface exposed, wherein the electrical wall plate has a plurality of side edges that define a periphery of the electrical wall plate, and wherein the backing does not cover at least one of the side edges and the backing does not cover the front appearance surface of the electrical wall plate;

at least one hardware fastener for mounting the electrical wall plate; and a fastener cavity for receiving the hardware fastener defined along the backing, wherein the hardware fastener does not retain the electrical wall plate to the backing.

20. The hardware packaging assembly of claim 19, wherein the electrical wall plate has an aperture extending from the back mounting surface through to the front appearance surface, and wherein the retention feature protrudes from the forward receiving surface of the package backing and extends through the aperture in the electrical wall plate.

21. The hardware packaging assembly of claim 20, wherein the retention feature includes at least one detent that is adapted to elastically deform and engage the aperture with a snap-fit.

22. The hardware packaging assembly of claim 20, wherein the retention feature is a protrusion shaped as at least one of a switch and an electrical receptacle and protrudes through aperture in the electrical wall plate and extend beyond the front appearance surface to simulate an installed configuration.

23. The hardware packaging assembly of claim 19, further comprising a display feature extending from the backing.

* * * * *